US010781635B2

(12) United States Patent
Cheng

(10) Patent No.: US 10,781,635 B2
(45) Date of Patent: Sep. 22, 2020

(54) FAST POSITIONING STRUCTURE OF SAFE POSITION LIMITING DEVICE OF ROLLER BLIND

(71) Applicant: CHEN TIAN CO., LTD., Tainan (TW)

(72) Inventor: Ching-Hsiang Cheng, Tainan (TW)

(73) Assignee: Chen Tian Co., Ltd., Tainan (TW)

( * ) Notice: Subject to any disclaimer, the term of this patent is extended or adjusted under 35 U.S.C. 154(b) by 209 days.

(21) Appl. No.: 16/004,614

(22) Filed: Jun. 11, 2018

(65) Prior Publication Data

US 2019/0376339 A1 Dec. 12, 2019

(51) Int. Cl.
*E06B 9/80* (2006.01)
*E06B 9/42* (2006.01)

(52) U.S. Cl.
CPC . *E06B 9/80* (2013.01); *E06B 9/42* (2013.01)

(58) Field of Classification Search
CPC ..... E06B 9/42; E06B 9/80; E06B 9/88
See application file for complete search history.

(56) References Cited

U.S. PATENT DOCUMENTS 4,513,805 A * 4/1985 Mase ..... E06B 9/80 160/299
4,681,279 A * 7/1987 Nakamura ..... E06B 9/68 160/294
6,158,563 A * 12/2000 Welfonder ..... E06B 9/90 160/291
7,497,242 B2 * 3/2009 Wang ..... E06B 9/42 160/238
8,844,605 B2 * 9/2014 Ng ..... E06B 9/90 160/319
8,893,766 B2 * 11/2014 Bohlen ..... E06B 9/88 160/323.1
10,451,145 B2 * 10/2019 Chen ..... F16F 15/18
2003/0178276 A1 * 9/2003 Fraczek ..... F16D 41/206 192/3.52
2006/0068962 A1 * 3/2006 Allsopp ..... E06B 9/78 475/182
2015/0191973 A1 * 7/2015 Bohlen ..... E06B 9/78 160/291
2015/0308188 A1 * 10/2015 Lin ..... B65H 75/486 242/375.3
2017/0058600 A1 * 3/2017 Mocanu ..... E06B 9/44
2018/0017110 A1 * 1/2018 Cheng ..... F16D 9/10
2018/0179816 A1 * 6/2018 Cheng ..... E06B 9/50
2019/0128058 A1 * 5/2019 Cheng ..... F16H 1/28
(Continued)

FOREIGN PATENT DOCUMENTS

TW M454156 U1 6/2013

*Primary Examiner* — James M Ference
(74) *Attorney, Agent, or Firm* — Rosenberg, Klein & Lee

(57) ABSTRACT

A fast positioning structure of a safe position limiting device of a roller blind is disclosed herein. It mainly comprises a controller having an axle rod, an axial rail limiting assembly assembled to the axle rod and having a screw member, an elastic member in the screw member, and an inner tube with which a first tooth part is provided, a touch member for limiting the inner tube in the screw member, a positioning member and a position limiting member disposed at an external of the screw member, and an outer sleeve tube disposed at an external of the screw member and having a seal cap with which a second tooth part is provided at one end thereof for corresponding to the first tooth part of the inner tube.

12 Claims, 12 Drawing Sheets

(56) References Cited

U.S. PATENT DOCUMENTS

| | | | | |
|---|---|---|---|---|
| 2019/0128059 | A1* | 5/2019 | Cheng | E06B 9/78 |
| 2019/0218855 | A1* | 7/2019 | Cheng | B65H 75/4431 |
| 2019/0218856 | A1* | 7/2019 | Cheng | B65H 75/4402 |
| 2019/0343318 | A1* | 11/2019 | Cheng | A47H 5/02 |
| 2019/0376339 | A1* | 12/2019 | Cheng | E06B 9/42 |

* cited by examiner

FAST POSITIONING STRUCTURE OF SAFE POSITION LIMITING DEVICE OF ROLLER BLIND

BACKGROUND OF THE INVENTION

1. Field of the Invention

The present invention relates to a fast positioning structure of a safe position limiting device of a roller blind which can be rapidly assembled and limit the vertically extending and shrinking position of a curtain fabric.

2. Description of Related Art

Generally, a curtain is assembled according to the length of its curtain fabric to adjust an assembling position of a travel path of a controller. For instance, a Taiwan Patent No. TWM454156 (U), issued on 1 Jun. 2013, has disclosed an "improved blind rod positioning structure". The structure comprises the following steps to assemble a blind rod including: assembling the blind rod to a positioning member for setting a winding up position of a first sleeve ring; disassembling the blind rod and screwing and positioning the first sleeve ring; reassembling the blind rod to the positioning member for setting a vertical extension position of a second sleeve ring; disassembling the blind rod and screwing and positioning the second sleeve ring; and finally reassembling the blind rod to the positioning member. It can be seen that the assembly of the abovementioned structure comprises many steps, which is very time consuming. Furthermore, if the abovementioned positioning structure is used to position a large curtain, two or more assembly personnel are required to complete the operation. Therefore, the traditional structure has the problems of assembly difficulty and waste of time and manpower.

SUMMARY OF THE INVENTION

Therefore, in view of the above-mentioned problems, the aspect of the present invention is to provide a fast positioning structure of a safe position limiting device of a roller blind which can be rapidly assembled and limit the vertically extending and shrinking position of a curtain fabric.

Disclosed herein is a fast positioning structure of a safe position limiting device of a roller blind. It mainly comprises a controller having an axle rod, an axial rail limiting assembly disposed at one end of the axle rod and having a screw member, an elastic member in the screw member, and an inner tube, a touch member for positioning the inner tube within the screw member, and a positioning member, a position limiting member and an outer sleeve tube screwing at an external of the screw member. The inner tube is further provided with a first tooth part on its end surface. The outer sleeve tube is provided with a seal cap at its one end, and the seal cap is further provided with a second tooth part corresponding to the first tooth part of the inner tube.

Accordingly, the outer ring gear of the positioning member can be engaged with the positioning ring for positioning when the curtain is opened, and the first tooth part of the inner tube can be engaged with the second tooth part for positioning by releasing the touch member when a curtain tube is rotated to a closed position so as to achieve the efficiency of automatic assembly and fast positioning without screws.

DETAILED DESCRIPTION OF THE PREFERRED EMBODIMENT

Figure 1:
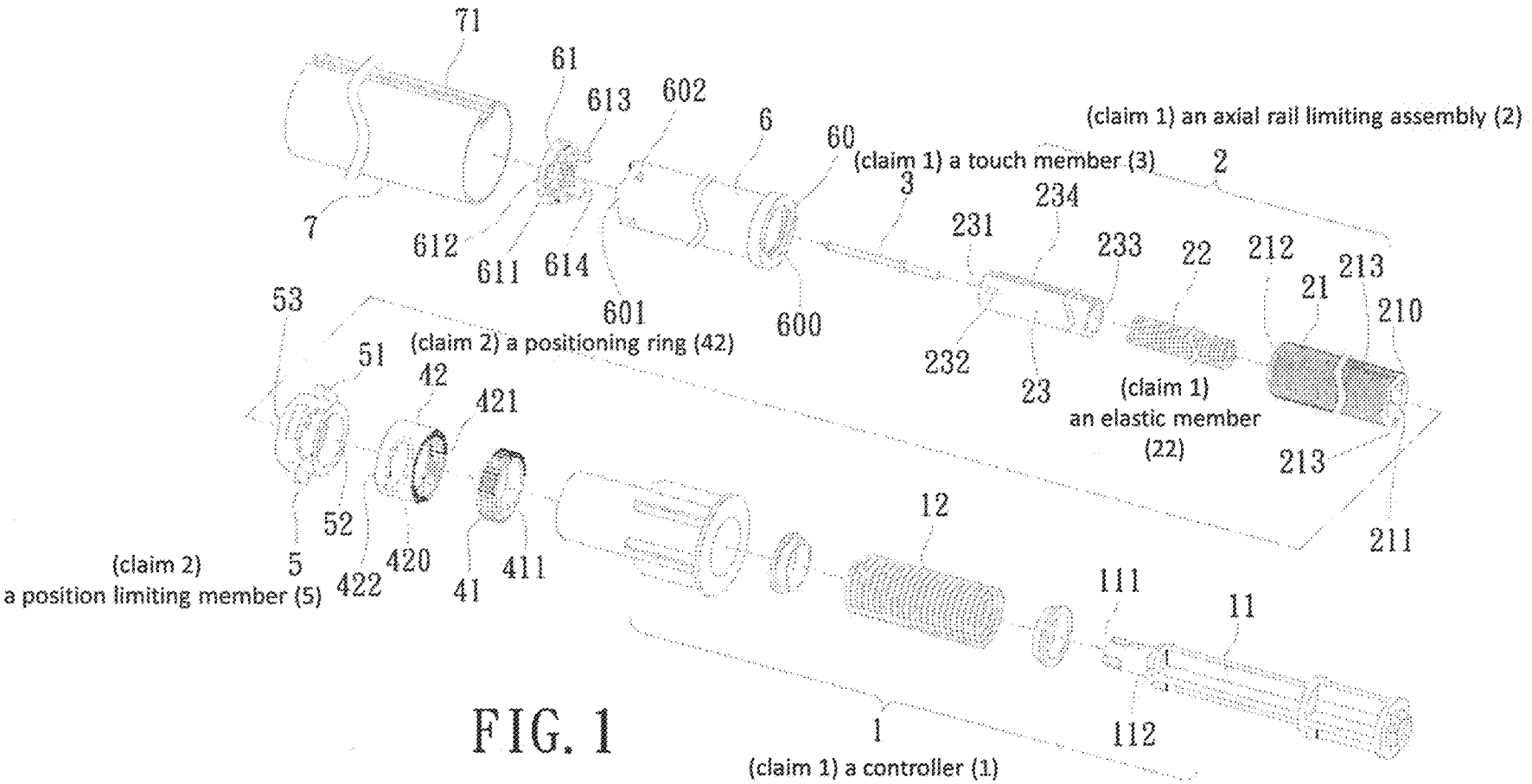
FIG. 1 is an explosion diagram showing a fast positioning structure of a safe position limiting device of a roller blind according to is the present invention.

Hereinafter, an exemplary embodiment of the present invention will be described in detail with reference to the accompanying drawings.

Referring to FIG. 1 to FIG. 4, a fast positioning structure of a safe position limiting device of a roller blind of the present invention is disclosed herein. It mainly comprises a controller (1), an axial rail limiting assembly (2), a touch member (3), a positioning member (4), a position limiting member (5), an outer sleeve tube (6), and a curtain tube (7).

The controller (1) is provided with an axle rod (11), and the axle rod (11) is further provided with a through hole (111) and an engaging part (112) on its outside.

Figure 3:
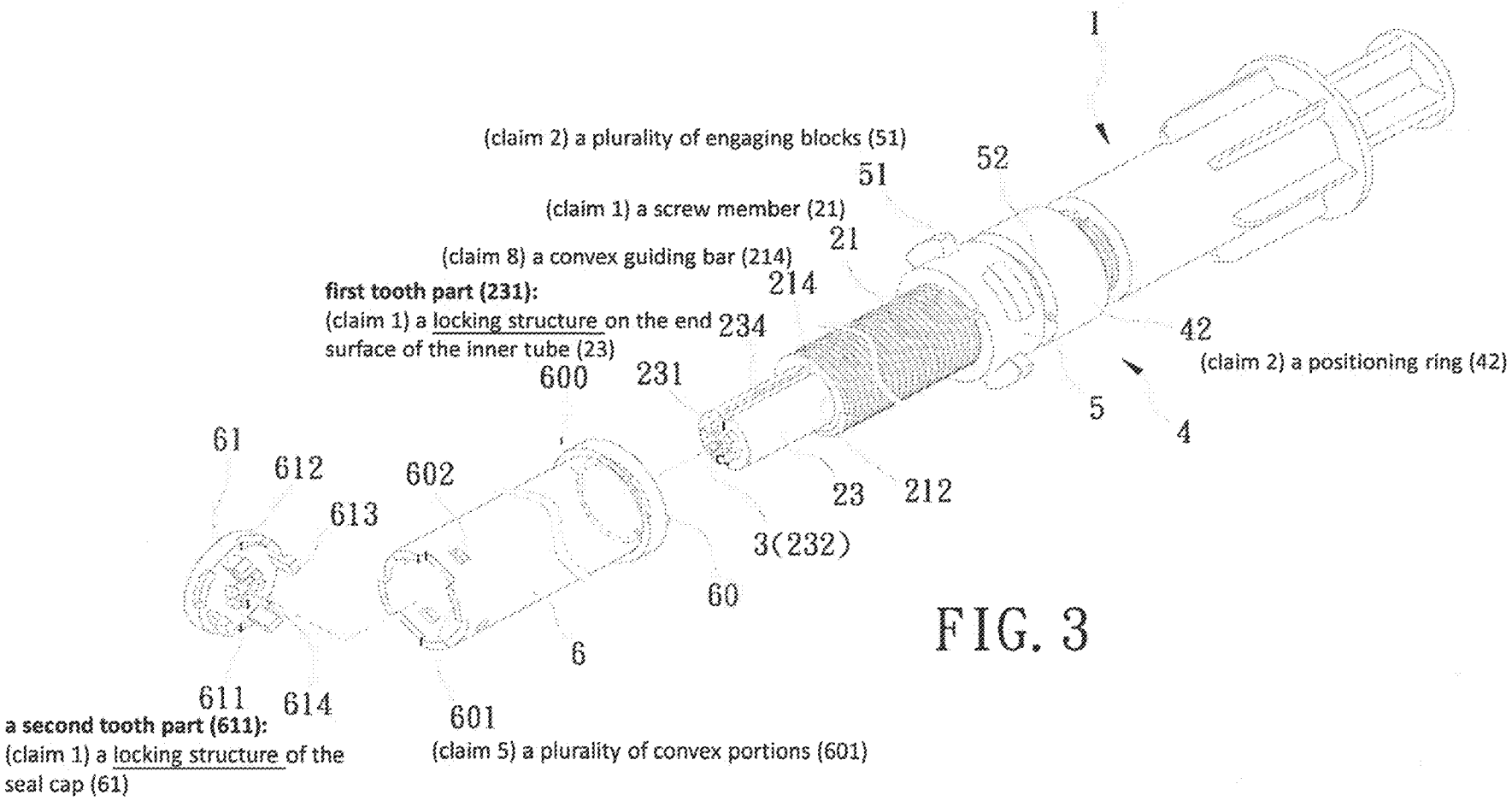
FIG. 3 is a partial explosion diagram showing an outer sleeve tube according to the present invention.

The axial rail limiting assembly (2) is provided with a screw member (21), an elastic member (22), and an inner tube (23). The screw member (21) is provided with an axle hole (211) on its first end surface for engaging with the axle rod (11) for positioning, a first chamber (212) in its second end surface for allowing corresponding insertion of the inner tube (23) and horizontal movement of the inner tube (23) in the first chamber (212), an engaging slot (210) for correspondingly engaging with the engaging part (112) and communicating with the first chamber (212), and a trench (213) at the first end of the screw member (21). The inner tube (23) is provided with a first tooth part (231) on its end surface, a central through hole (232), and a second chamber (233) therein for communicating with the central through hole (232) and accommodating the elastic member (22). The inner tube (23) is correspondingly inserted into the first chamber (212) of the screw member (21) for horizontal movement. Furthermore, an outer surface of the inner tube (23) is axially provided with a rail (234), and an inner surface of the first chamber (212) is provided with a convex guiding bar (214) corresponding to the rail (234) for allowing horizontal movement of the inner tube (23) (as shown in FIG. 3).

The touch member (3) is correspondingly inserted into the central through hole (232) of the inner tube (23), the elastic member (22), the screw member (21) and the through hole (111) of the controller (1) for positioning and to compress the elastic member (22) to limit the inner tube (23) within the first chamber (212) of the screw member (21) or release the inner tube (23) for horizontal movement.

The positioning member (4) is provided with an outer ring gear (41) and a positioning ring (42). The outer ring gear (41) is disposed at an external of the screw member (21) and further having a lug (411) for moving on the trench (213) at the first end of the screw member (21), and the positioning ring (42) is further provided with a tooth ring (420) and an inner ring gear (421) for respectively screwing with the screw member (21) and the outer ring gear (41). Moreover, the positioning ring (42) is provided with an engaging tooth part (422) corresponding to an outer edge of the tooth ring (420).

The position limiting member (5) is screwed at the external of the screw member (21) to be on one side of the positioning ring (42) of the positioning member (4) and provided with a plurality of engaging blocks (51) at its outer edge, a first locking block (52) at its one end for correspondingly engaging with the engaging tooth part (422) of the positioning ring (42), and a second locking block (53) at the other end.

The outer sleeve tube (6) is provided with an inner tooth ring (600) for correspondingly screwing at the external of the screw member (21), a jointing block (60) at its one end for correspondingly engaging with the second locking block (53) of the position limiting member (5), and a seal cap (61) disposed at the other end or integrally formed with the outer sleeve tube (6). An end surface of the seal cap (61) is provided with a second tooth part (611) corresponding to the first tooth part (231) on the end surface of the inner tube (23) for correspondingly engaging with or detaching from the first tooth part (231).

The curtain tube (7) is assembled to an external of the position limiting member (5) and provided with a recessed slot (71) for correspondingly engaging between the two adjacent engaging blocks (51).

Figure 2:
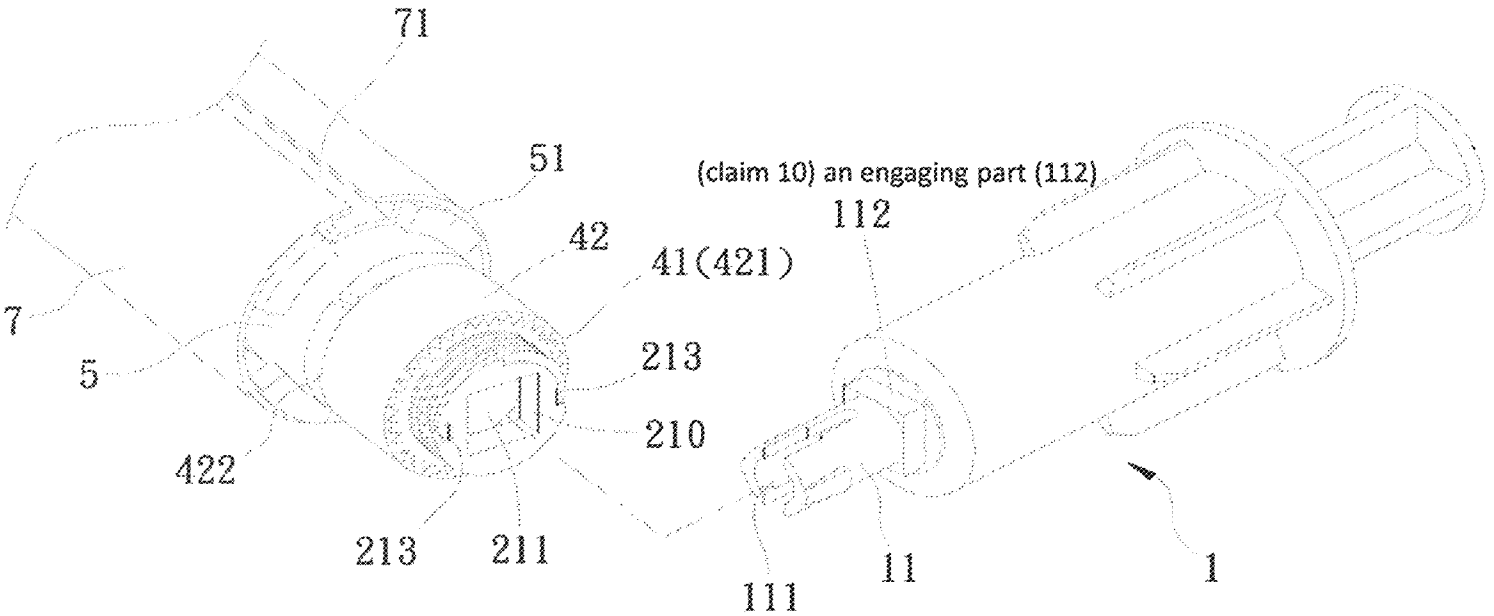
FIG. 2 is a schematic diagram showing an axle rod of a controller and an axial rail limiting assembly according to the present invention.
Figure 4:
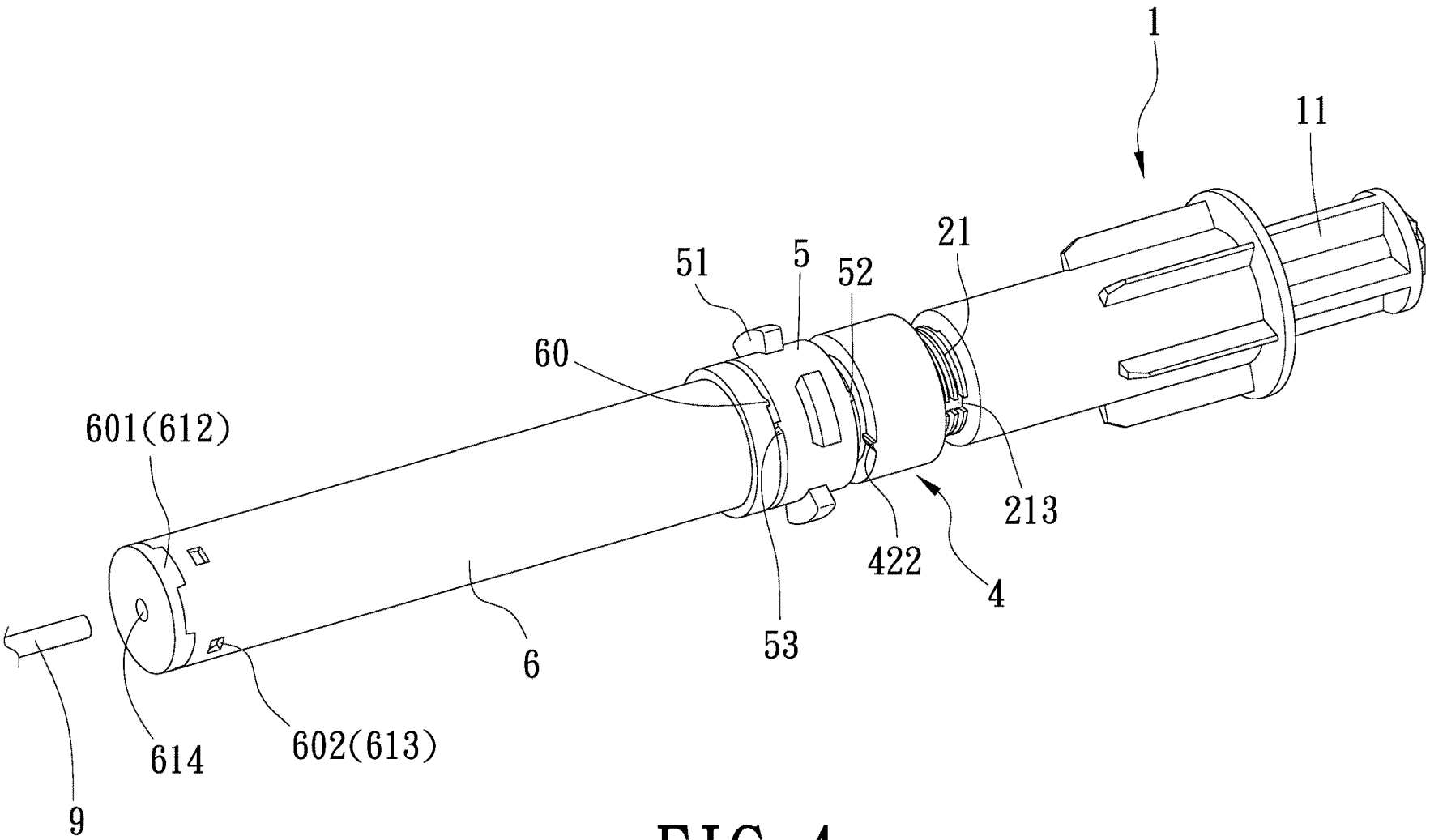
FIG. 4 is a stereogram showing a fast positioning structure of a safe position limiting device of a roller blind in assembly according to the present invention.
Figure 5:
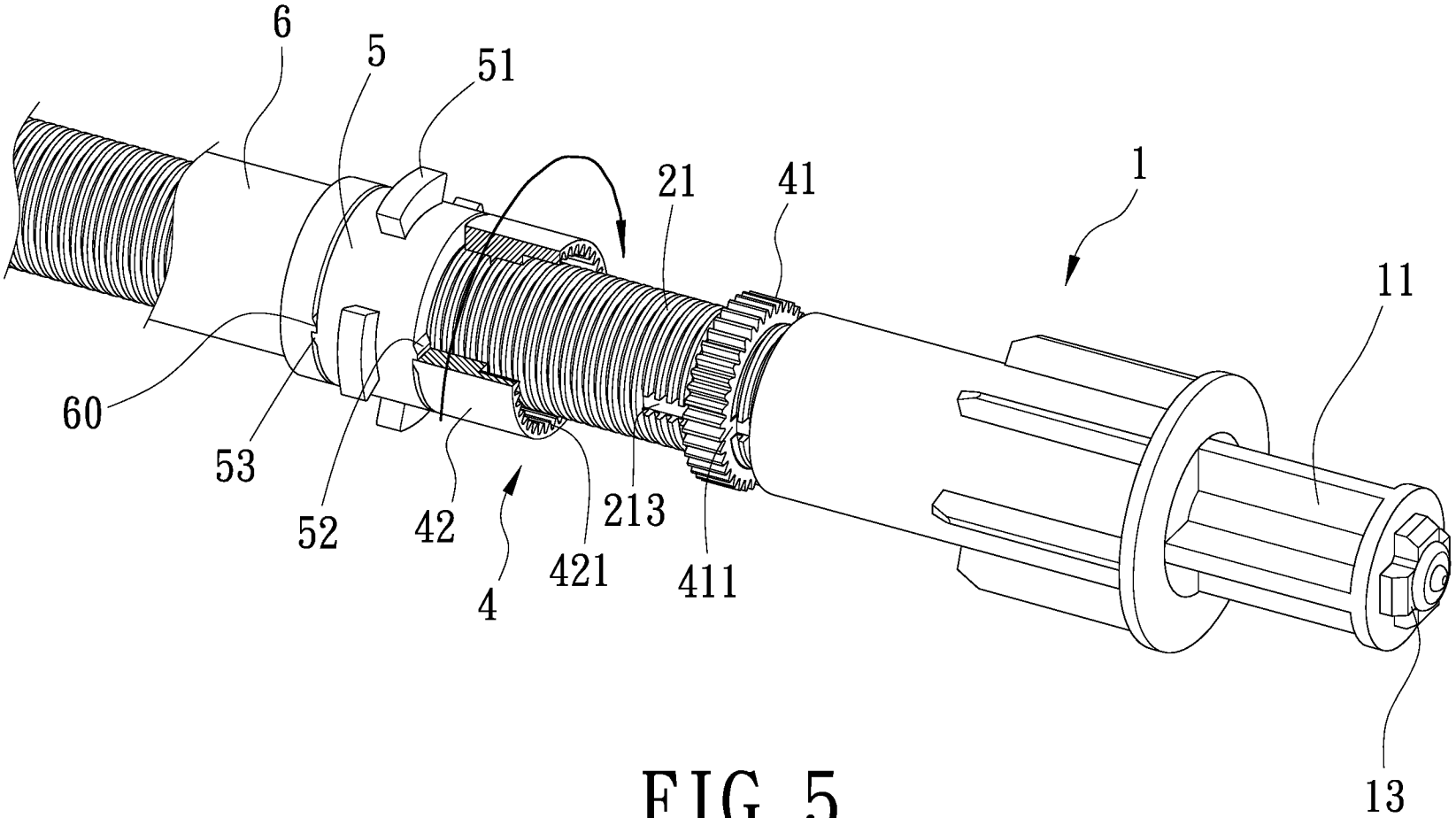
FIG. 5 is a first schematic diagram showing an outer ring gear moving on a screw member and toward a positioning ring for controlling a vertical extension of a curtain according to the present invention.
Figure 6:
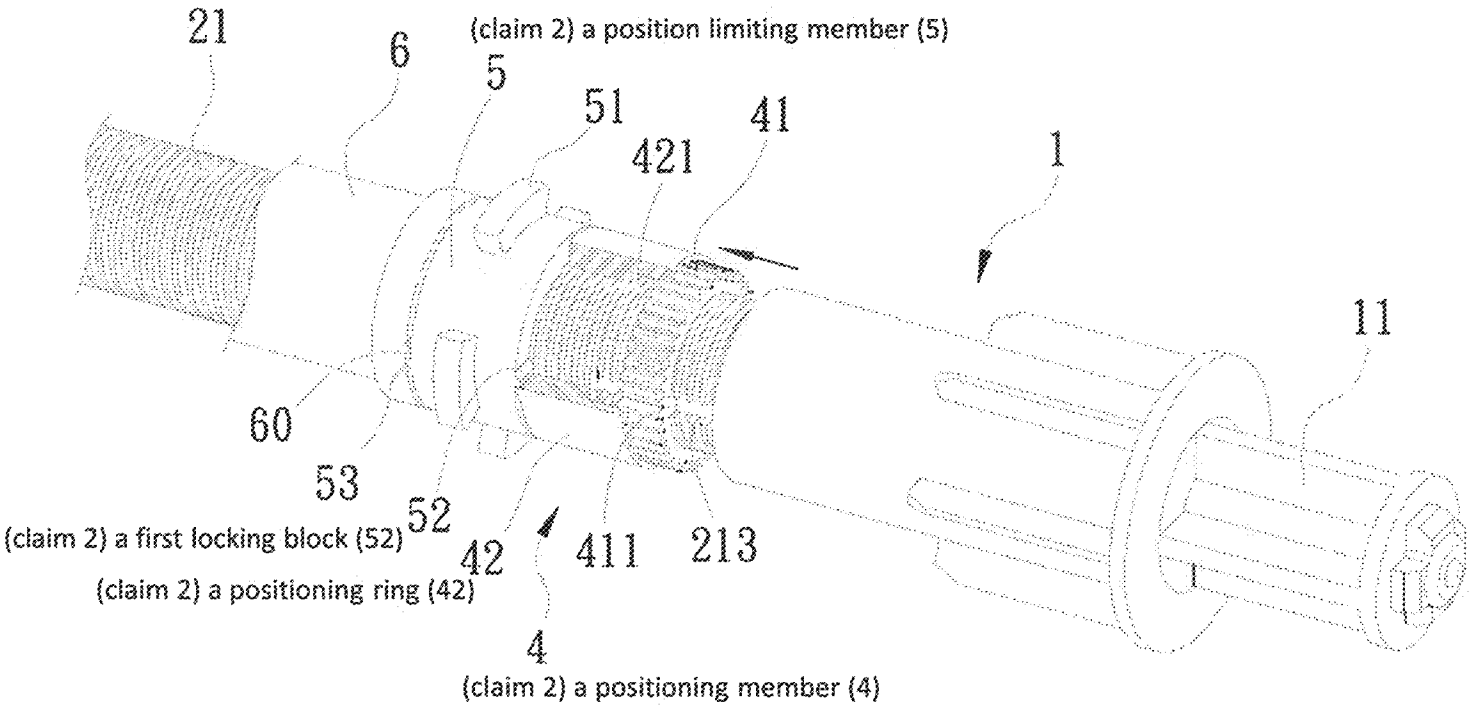
FIG. 6 is a second schematic diagram showing an outer ring gear engaged with an inner ring gear of a positioning ring for positioning and controlling a vertical extension of a curtain according to the present invention.
Figure 7:
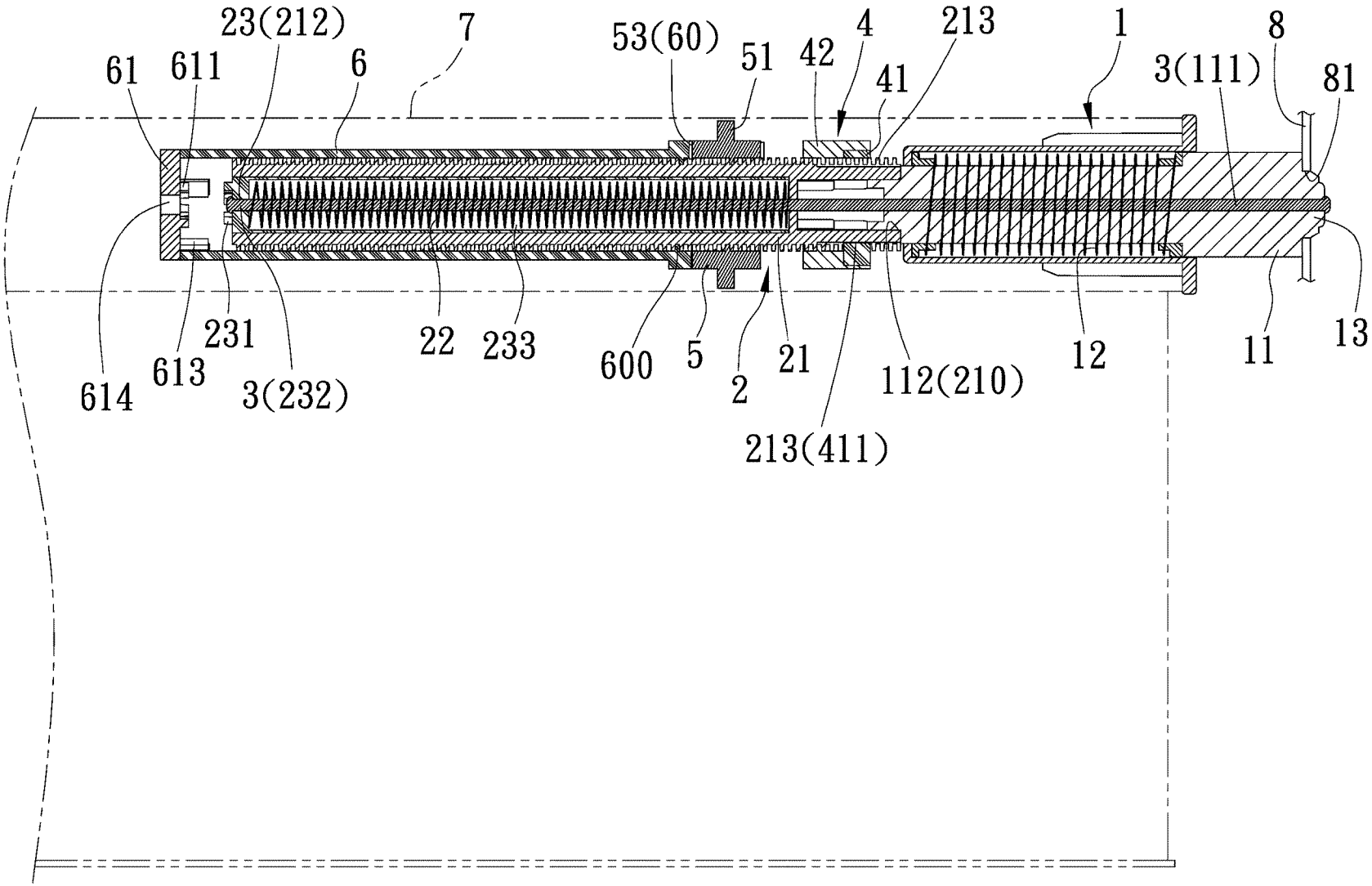
FIG. 7 is a cross-sectional view showing a fast positioning structure of a safe position limiting device of a roller blind in an extension state according to the present invention.
Figure 8:
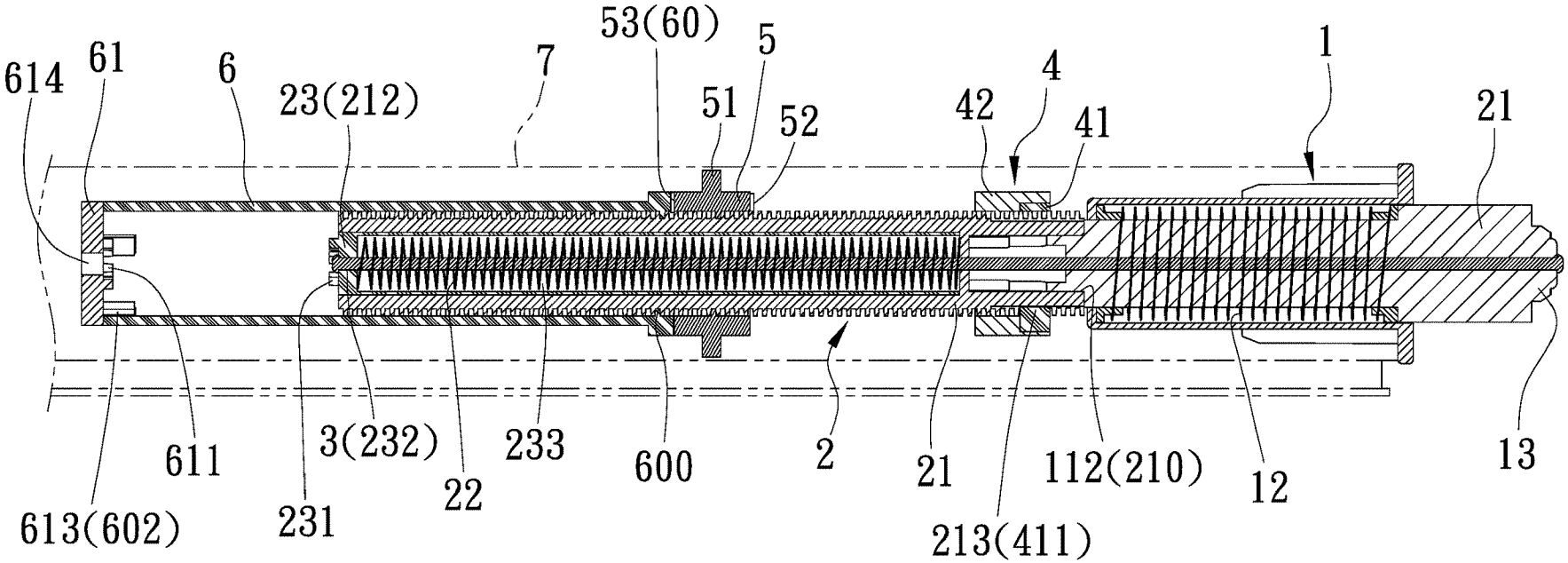
FIG. 8 is a first cross-sectional view showing a fast positioning structure of a safe position limiting device of a roller blind in a winding state before releasing a touch member according to the present invention.
Figure 9:
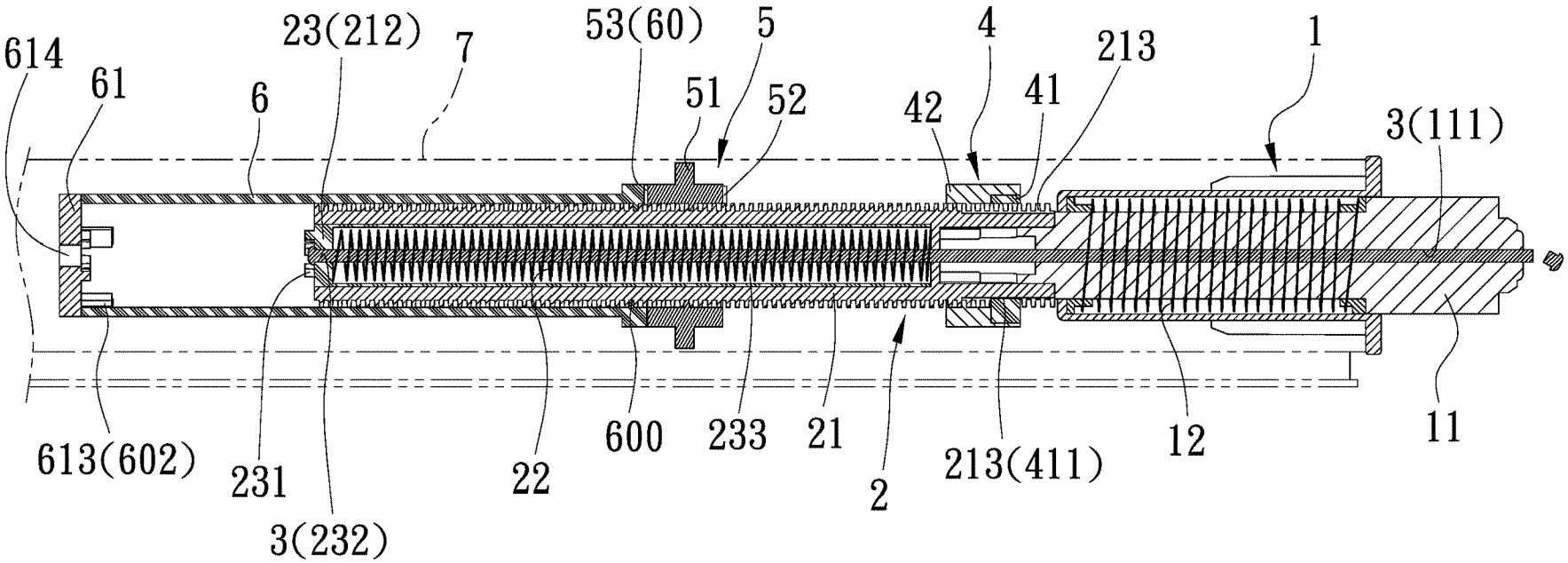
FIG. 9 is a second cross-sectional view showing a fast positioning structure of a safe position limiting device of a roller blind in a winding state and releasing a touch member according to the present invention.
Figure 10:
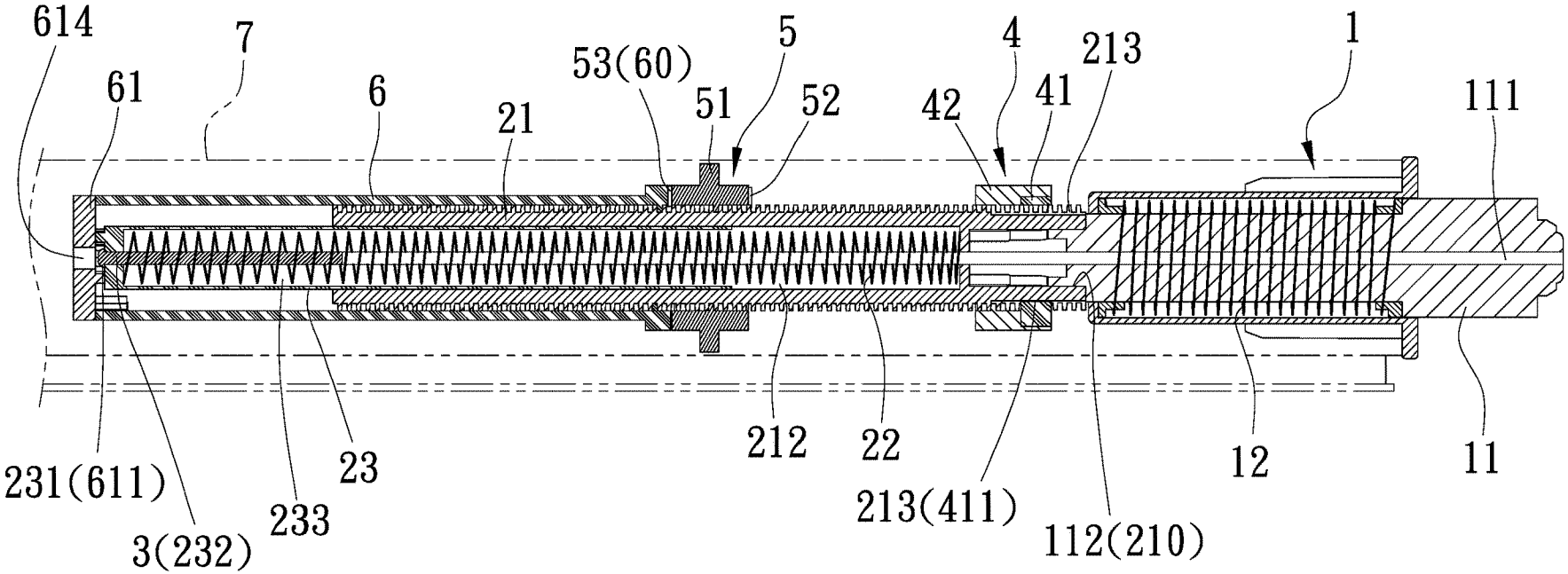
FIG. 10 is a third cross-sectional view showing a fast positioning structure of a safe position limiting device of a roller blind in a winding state after releasing a touch member according to the present invention.
Figure 11:
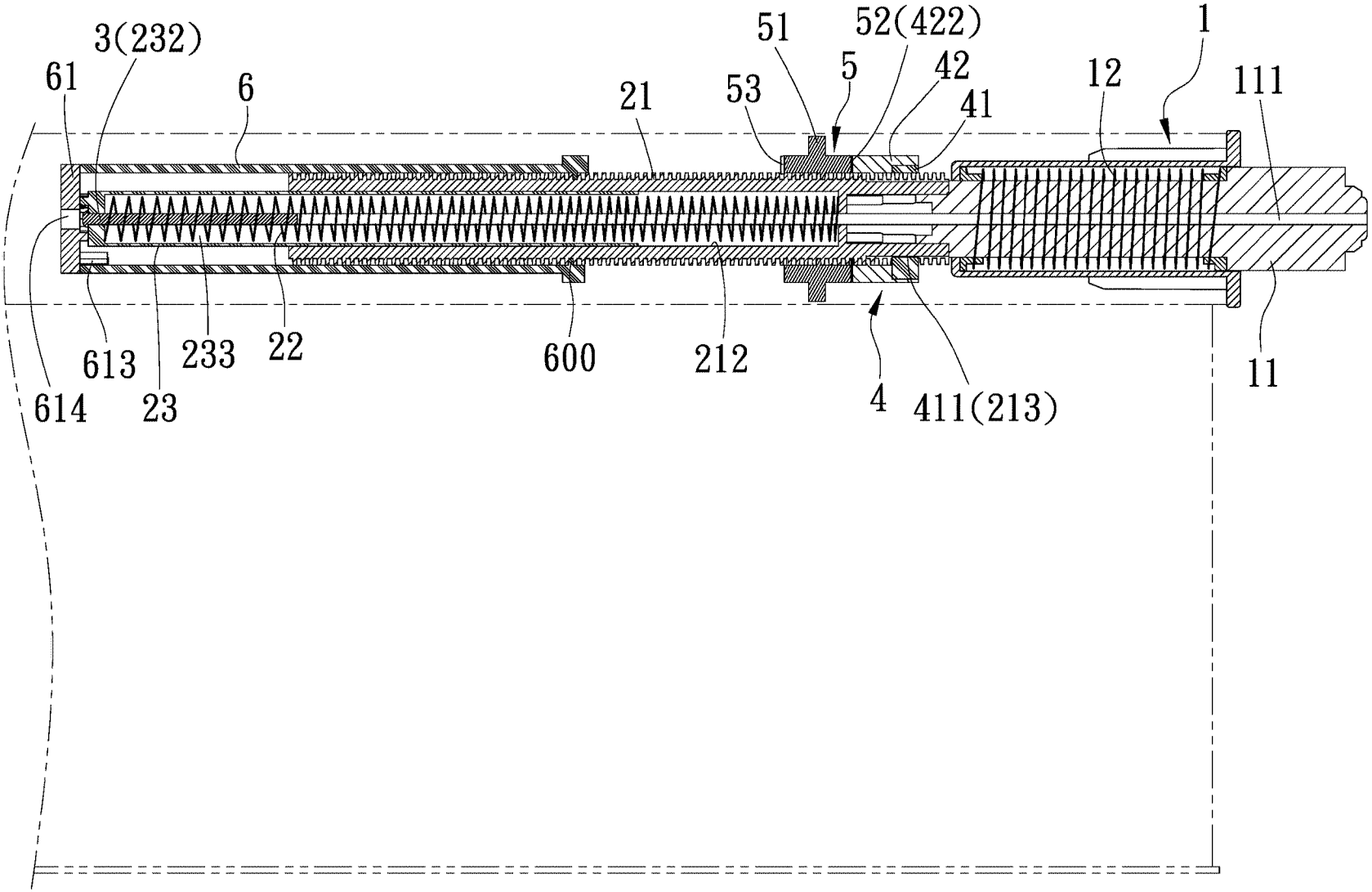
FIG. 11 is a cross-sectional view showing a curtain vertically extended according to the present invention.
Figure 12:
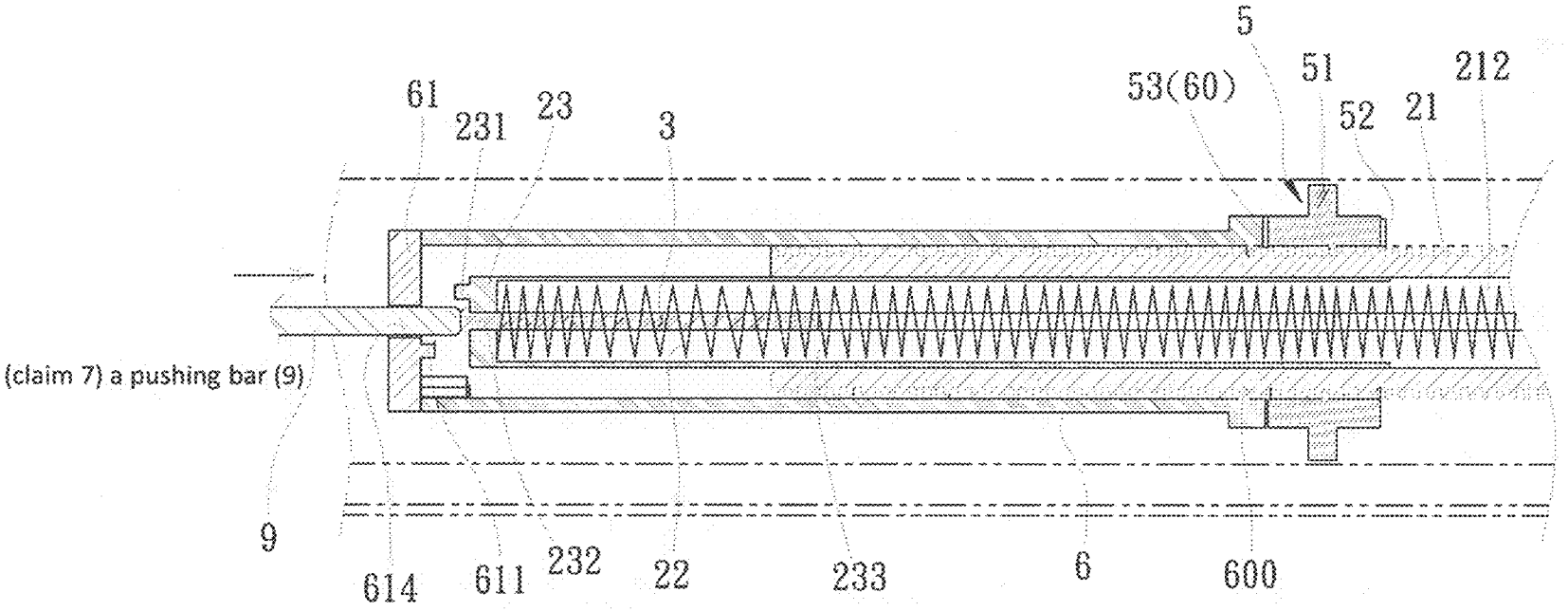
FIG. 12 is a cross-sectional view showing a curtain in adjustment according to the present invention.

Referring to FIG. 1 to FIG. 11, in practical assembly of the present invention, the outer ring gear (41) of the positioning member (4) is assembled to the screw member (21) before the controller (1) is assembled to the axial rail limiting assembly (2) so that the lug (411) of the outer ring gear (41) is correspondingly engaged with the trench (213) of the screw member (21). Then, the controller (1) is precisely assembled to the screw member (21) by correspondingly engaging the axle rod (11) with the axle hole (211) of the screw member (21). The outside of the axle rod (11) is provided with the engaging part (112) shaped as a polygonal block, and the axle hole (211) of the screw member (21) is provided with the engaging slot (210) (e.g. a polygonal slot) for correspondingly engaging with the engaging part (112) and communicating with the first chamber (212) (as shown in FIG. 2). The elastic member (22) is inserted into the second chamber (233) of the inner tube (23), and then the inner tube (23) is inserted into the first chamber (212) of the screw member (21) so that the elastic member (22) and the inner tube (23) are accommodated in the first chamber (212) of the screw member (21). The outer surface of the inner tube (23) is axially provided with the rail (234), and the inner surface of the first chamber (212) is provided with the convex guiding bar (214) corresponding to the rail (234) for allowing horizontal movement of the inner tube (23) (as shown in FIG. 3). Meanwhile, the touch member (3) is correspondingly inserted into the central through hole (232) of the inner tube (23), the elastic member (22), the axle hole (211) of the screw member (21) and the through hole (111) in the controller (1) for positioning and for compressing the elastic member (22) to limit the inner tube (23) within the first chamber (212) of the screw member (21). Preferably, the touch member (3) is a rope, a rod and the like and can be positioned by knotting a rope, clamping a buckle on a rope, or clamping a fastener (e.g. a C type buckle and the like) on a rod body (as shown in FIG. 4 and FIG. 7).

The external of the screw member (21) is screwed to the positioning ring (42), the position limiting member (5) and the outer sleeve tube (6). The other end of the outer sleeve tube (6) is integrally formed with the seal cap (61) or provided with the seal cap (61). In order to ensure that the seal cap (61) is fixed and does not rotate, a plurality of grooves (612) are provided at an outer edge of the seal cap (61), and a plurality of convex portions (601) are also provided for correspondingly engaging with the plurality of grooves (612). The outer sleeve tube (6) is further provided with a plurality of hooks (613) on the end surface of the seal cap (61) and a plurality of locking slots (602) for correspondingly engaging with the plurality of hooks (613), so the seal cap (61) is firmly assembled at one end of the outer sleeve tube (6). As shown in FIG. 4, the jointing block (60) on the outer sleeve tube (6) is correspondingly interlocked with the second locking block (53) of the position limiting member (5) for move, and the first locking block (52) of the position limiting member (5) is correspondingly interlocked with the engaging tooth part (422) of the positioning ring (42) for move.

Referring to FIG. 5 to FIG. 11, to assemble the present structure for adjusting the vertically extending and shrinking position of a curtain fabric, the positioning ring (42) is screwed into the screw member (21) in the direction of the outer ring gear (41). Then, the positioning ring (42) is engaged with the first locking block (52) of the position limiting member (5) by the engaging tooth part (422), and the second locking block (53) of the position limiting member (5) is engaged with the jointing block (60) of the outer sleeve tube (6) so that the position limiting member (5) and the outer sleeve tube (6) are rotated simultaneously when the positioning ring (42) is screwed in (as shown in FIG. 5). After the above elements are screwed in and close to the outer ring gear (41), the curtain fabric on the curtain tube (7) is correspondingly assembled to the outside of the position limiting member (5) in an unfolded state. At the same time, if a space between the two adjacent engaging blocks (51) is not corresponding to allow insertion of the recessed slot (71) of the curtain tube (7), the position limiting member (5) can be slightly turned to allow the two adjacent engaging blocks (51) of the position limiting member (5) to correspondingly engage with two sides of the recessed slot (71) for positioning. Furthermore, when the position limiting member (5) is turned slightly, the outer sleeve tube (6) together with the positioning ring (42) are driven to turn simultaneously. In such a case, after the curtain tube (7) with vertically extended curtain fabric is assembled to the position limiting member (5), the outer ring gear (41) is pushed and can be correspondingly moved along the trench (213) of the screw member (21) by the lug (411) and to the inner ring gear (421) of the positioning ring (42) for engagement. After the outer ring gear (41) is engaged with the inner ring gear (421) of the positioning ring (42), the positioning ring (42) is locked in a fixed position where is also the end position of the curtain tube (7) driving the position limiting member (5) to rotate and controlling the curtain fabric to extend (as shown in FIG. 5 to FIG. 7).

Referring to FIG. 8 to FIG. 11, after the setting of the extending position of the curtain fabric is completed, the curtain fabric starts to be wound and the position limiting member (5) is rotated in an opposite direction. Meanwhile, the position limiting member (5) only drives the outer sleeve tube (6) to rotate, but not drives the positioning ring (42) (which is locked) to rotate. When the curtain fabric is wound to an appropriate position, the touch member (3) is released. As the embodiment described above, the touch member (3) is a rope, a rod and the like and can be positioned by knotting a rope, clamping a buckle on a rope, or clamping a fastener (e.g. a C type buckle and the like) on a rod body (as shown in FIG. 4 and FIG. 7). To release the touch member (3), the knot can be cut off, or the buckle and the fastener can be disassembled. In such a case, the elastic member (22) in the second chamber (233) of the inner tube (23) is no longer compressed and restores its elastic force to push the inner tube (23) out of the screw member (21) of the first chamber (212), allowing the first tooth part (231) on the end surface of the inner tube (23) to correspondingly engage with the second tooth part (611) of the seal cap (61) of the outer sleeve tube (6). The outer sleeve tube (6) is then locked in a fixed position where is also the start position of the curtain tube (7) driving the position limiting member (5) to rotate and controlling the curtain fabric to shrink. The locking structure of the inner tube (23) and the outer sleeve tube (6) are not limited to the first tooth part (231) and the second tooth part (611) as described above. Any locking structures, e.g. a concave portion, a convex portion, and the like, are also possible to form on the inner tube (23) and the outer sleeve tube (6) for allowing corresponding engagement with each other.

Additionally, after the setting of the shrinking position of the curtain fabric is completed, some factors may cause slight deviations in the set position, e.g. reassembly of a bead chain plate. In such a case, a perforation (614) is further provided on the seal cap (61) for corresponding to the central through hole (232) on the first tooth part (231) of the inner tube (23), and a pushing bar (9) is further provided for correspondingly inserting from the perforation (614) to the inner tube (23) so as to push against the end surface of the inner tube (23) and to disengage the first tooth part (231) from the second tooth part (611). Meanwhile, the outer sleeve tube (6) is rotated to adjust the position of the curtain fabric. After the position of the curtain fabric is adjusted, the pushing bar (9) is withdrawn, and the first tooth part (231) and the second tooth part (611) are engaged with each other again for positioning so as to achieve the adjustment of the start position.

As shown in FIG. 1, after the setting of the extending position and the shrinking position is completed, the fast positioning structure of a safe position limiting device of a roller blind is assembled to a side frame (8) of a fixed roller blind. The side frame (8) is provided with a cross hole (81), and the controller (1) is further provided with a cross rib (13) for correspondingly engaging with the cross hole (81). Moreover, due to the slight difference in spacing between the side frame (8) and the entire roller blind, a flexible member (12) is provided in the controller (1), which can be compressed or stretched to solve the problem of the spacing difference and to make the entire roller blind firmly fixed in the side frame (8).

According to the above description, in comparison with the traditional technique, a fast positioning structure of a safe position limiting device of a roller blind according to the present invention has the advantages as following:

1. The present invention achieves effects of easily and rapidly limiting the vertically extending and shrinking position of the curtain fabric by pushing the outer ring gear of the positioning member to move and engage in the inner ring gear of the positioning ring without the use of screws.

2. The mechanism of releasing the touch member allows the elastic member to push the inner tube into engagement with the second tooth part of the outer sleeve tube, so the curtain fabric of the roller blind can be wound directly to the highest point to set the assembly position. Accordingly, the present invention achieves effects of rapidly positioning, saving manpower, and solving the problem of the traditional structure that needs manually assemble and disassemble the positioning member to adjust the extending and shrinking position of the curtain fabric.

What is claimed is:

1. A fast positioning structure of a safe position limiting device of a roller blind, comprising:

a controller having an axle rod, wherein the axle rod is further provided with a through hole;

an axial rail limiting assembly having a screw member, an elastic member, and an inner tube, wherein the screw member is provided with an axle hole on a first end surface thereof for engaging with the axle rod for positioning, and a first chamber in a second end surface thereof for allowing corresponding insertion of the inner tube and horizontal movement of the inner tube therein, and wherein the inner tube is provided with a central through hole on an end surface thereof and a second chamber therein for communicating with the central through hole and accommodating the elastic member;

a touch member for correspondingly inserting into the central through hole of the inner tube, the elastic member, the screw member and the through hole in the controller for positioning and for compressing the elastic member to limit the inner tube within the first chamber of the screw member or release the inner tube for horizontal movement; and an outer sleeve tube having an inner tooth ring for correspondingly screwing at an external of the screw member and a seal cap at one end thereof, wherein an end surface of the seal cap is provided with a locking structure corresponding to a locking structure on the end surface of the inner tube for correspondingly locking the inner tube in the outer sleeve tube or separating the inner tube from the outer sleeve tube.

2. The fast positioning structure of a safe position limiting device of a roller blind as claimed in claim 1, further comprising a positioning member having an outer ring gear disposed at the external of the screw member and further having a lug for moving on a trench at the first end of the screw member, and a positioning ring further having a tooth ring and an inner ring gear for respectively screwing with the screw member and the outer ring gear; and a position limiting member screwed at the external of the screw member to be on one side of the positioning ring of the positioning member and having a plurality of engaging blocks at an outer edge thereof for correspondingly engaging with a curtain tube disposed with a curtain fabric, and a first locking block for correspondingly engaging with an engaging tooth part of the positioning ring.

3. The fast positioning structure of a safe position limiting device of a roller blind as claimed in claim 1, wherein the locking structure comprises a first tooth part on the end surface of the inner tube and a second tooth part on the end surface of the seal cap for correspondingly engaging with or detaching from the first tooth part.

4. The fast positioning structure of a safe position limiting device of a roller blind as claimed in claim 1, wherein the seal cap is integrally formed with the outer sleeve tube.

5. The fast positioning structure of a safe position limiting device of a roller blind as claimed in claim 1, wherein an outer edge of the seal cap is provided with a plurality of grooves, and the outer sleeve tube is provided with a plurality of convex portions for correspondingly engaging with the plurality of grooves.

6. The fast positioning structure of a safe position limiting device of a roller blind as claimed in claim 3, wherein the outer sleeve tube is further provided with a plurality of locking slots and a plurality of hooks on the end surface of the seal cap for hooking on the plurality of locking slots for positioning.

7. The fast positioning structure of a safe position limiting device of a roller blind as claimed in claim 3, wherein the end surface of the seal cap is provided with a perforation corresponding to the central through hole on the end surface of the inner tube for allowing insertion of a pushing bar from the perforation to the inner tube to push against the end surface of the inner tube and disengage the first tooth part from the second tooth part.

8. The fast positioning structure of a safe position limiting device of a roller blind as claimed in claim 7, wherein an outer surface of the inner tube is axially provided with a rail, and wherein an inner surface of the first chamber is provided with a convex guiding bar corresponding to the rail for allowing horizontal movement of the inner tube.

9. The fast positioning structure of a safe position limiting device of a roller blind as claimed in claim 8, wherein the touch member is positioned by knotting a rope, clamping a buckle on a rope, or clamping a fastener on a rod body.

10. The fast positioning structure of a safe position limiting device of a roller blind as claimed in claim 9, wherein an outside of the axle rod of the controller is provided with an engaging part shaped as a polygonal block, and wherein the axle hole of the screw member is provided with an engaging slot for correspondingly engaging with the engaging part and communicating with the first chamber.

11. The fast positioning structure of a safe position limiting device of a roller blind as claimed in claim 10, wherein the controller is provided with a flexible member therein.

12. The fast positioning structure of a safe position limiting device of a roller blind as claimed in claim 11, wherein the controller is further provided with a cross rib for correspondingly engaging with a cross hole of a side frame.

* * * * *